US005160052A

United States Patent [19]

Wudka

[11] Patent Number: 5,160,052

[45] Date of Patent: Nov. 3, 1992

[54] SHELF SUPPORT ASSEMBLY

[76] Inventor: Michael Wudka, 5711 Ravenspur Dr. No. 311, Rancho Palos Verdes, Calif. 90274

[21] Appl. No.: 785,481

[22] Filed: Oct. 31, 1991

[51] Int. Cl.[5] ..... A47F 5/00

[52] U.S. Cl. ..... 211/90; 211/106; 211/187; 108/152

[58] Field of Search ..... 211/90, 106, 103, 187, 211/181; 108/106, 107, 108, 152

[56] References Cited

U.S. PATENT DOCUMENTS

| | | | |
|---|---|---|---|
| 847,523 | 3/1907 | Stirton | 211/106 X |
| 919,526 | 4/1909 | Belcher | 211/90 X |
| 1,685,277 | 9/1928 | Dryden | 211/106 X |
| 2,222,831 | 11/1940 | Bitney | 211/106 X |
| 2,839,202 | 6/1958 | Arnett | 211/106 |
| 4,391,378 | 7/1983 | Secon | 211/187 |

FOREIGN PATENT DOCUMENTS

| | | | |
|---|---|---|---|
| 584707 | 11/1958 | Italy | 211/90 |

*Primary Examiner*—Robert W. Gibson, Jr.

[57] ABSTRACT

The shelf support assembly comprises an elongated, vertical support member; a plurality of substantially U-shaped, horizontal support members; and a vertically disposed, elongated, connecting member. The U-shaped, horizontal support members are in spaced parallel relationship along at least a portion of the length of the vertical support member. The horizontal support members each comprise a base portion with first and second arms depending therefrom. The ends of each of the first arms are securely connected to a first side of the vertical support member and the ends of each of the second arms are securely connected to the second side of the vertical support member. The vertically disposed connecting member is securely attached to the base portions of the U-shaped, horizontal support members to provide rigidity of the shelf support assembly. When two support assemblies are positioned in spaced planar relationship to each other at a desired distance to accommodate a shelf, such a shelf may be supported at a first end by at least one arm of one of the U-shaped, horizontal support members and at a second end by at least one arm of an associated U-shaped, horizontal support member on the other support assembly.

11 Claims, 4 Drawing Sheets

FIG_1b
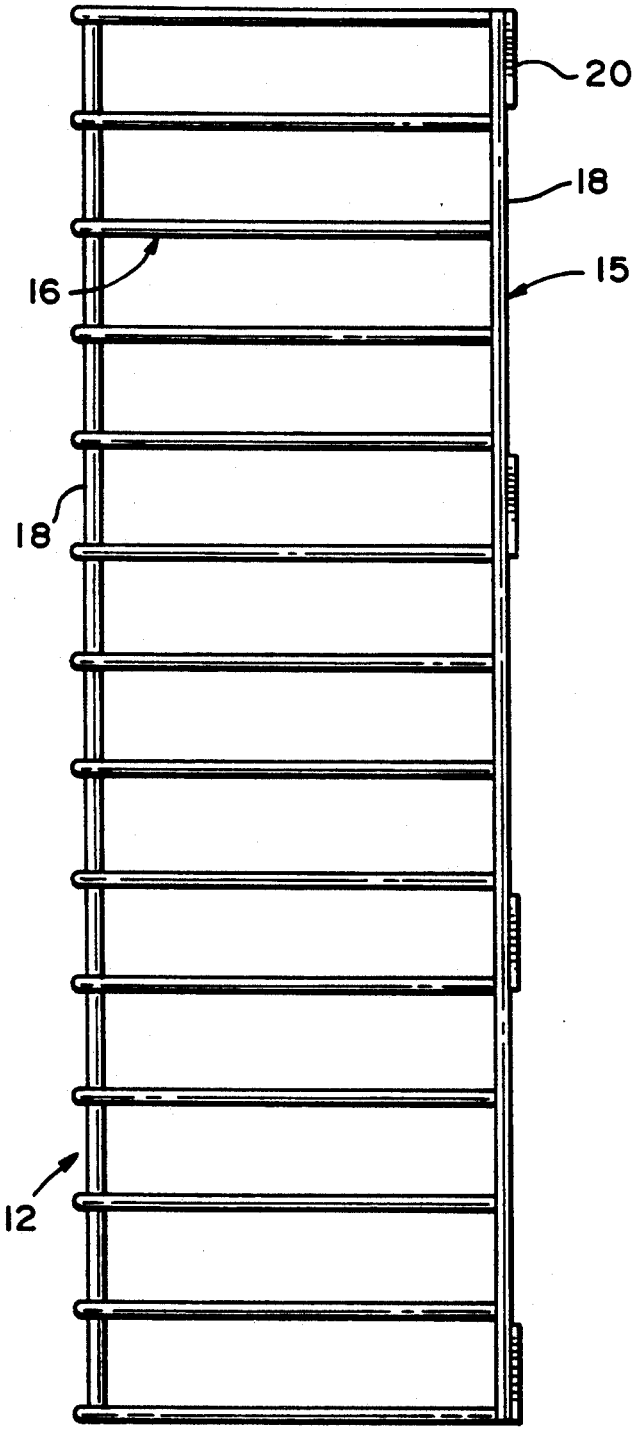
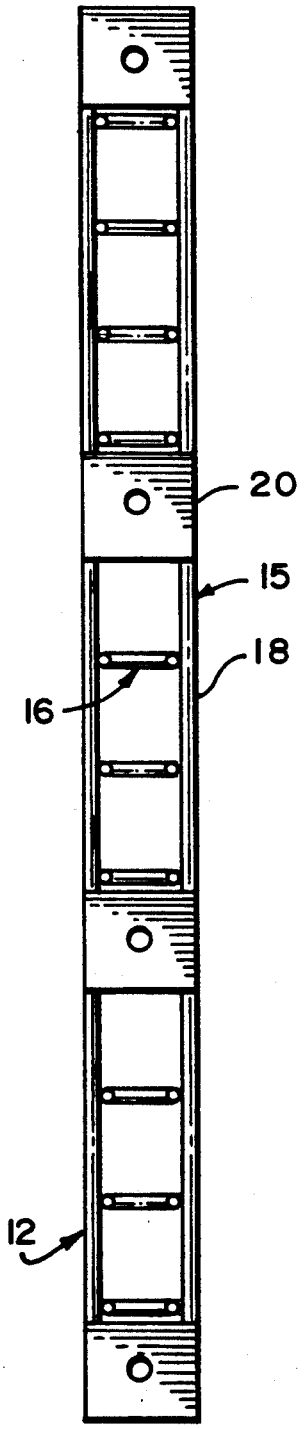
FIG_1d
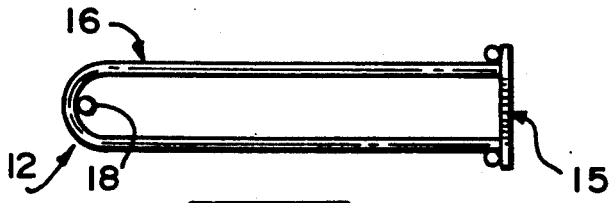
FIG_1c

FIG. 2b
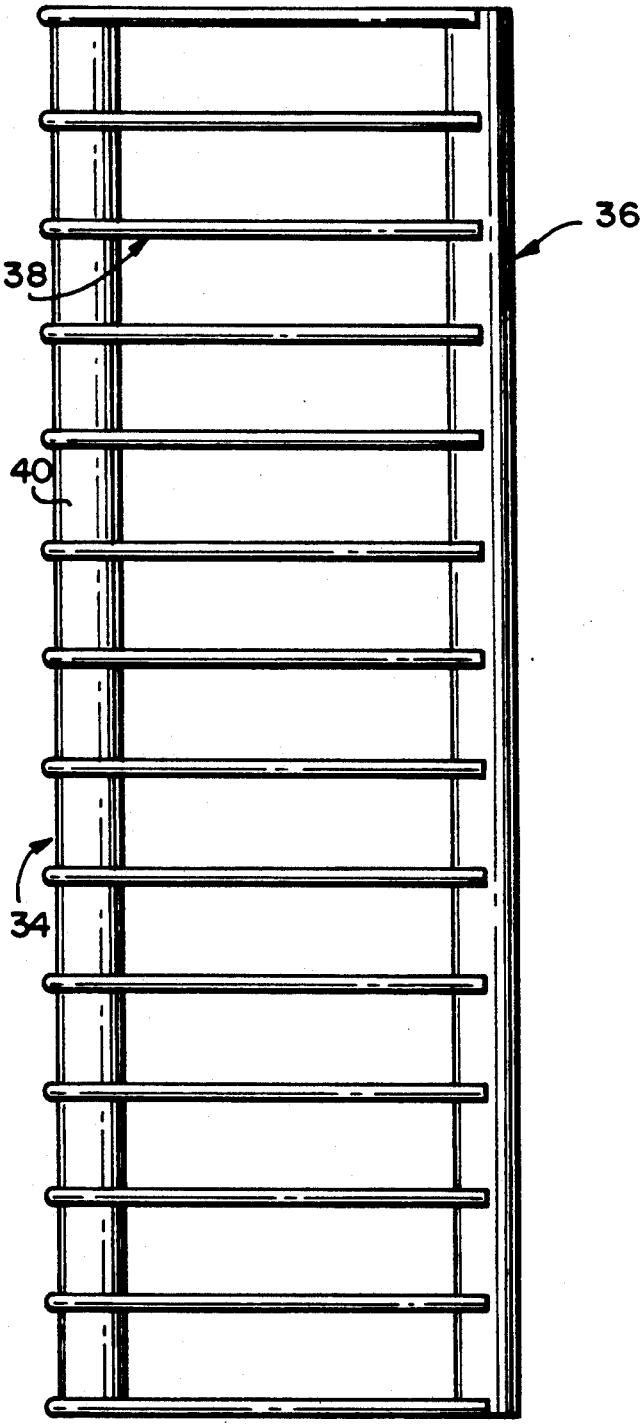
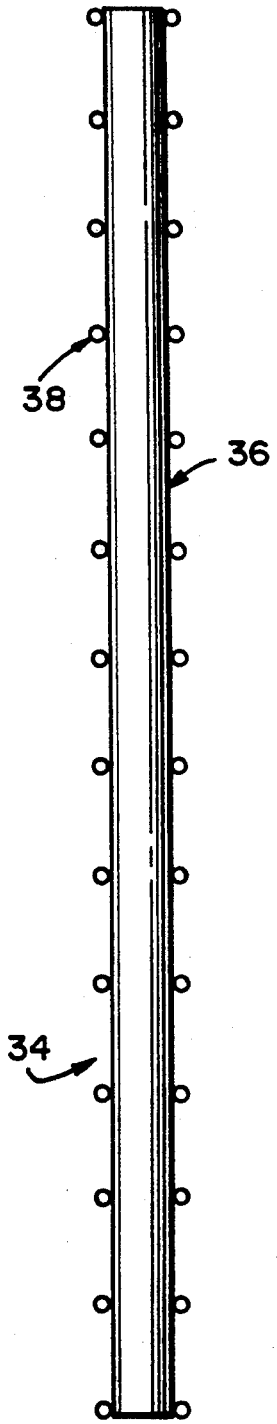
FIG. 2d
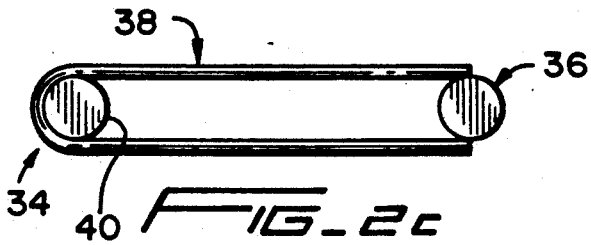
FIG. 2c

SHELF SUPPORT ASSEMBLY

BACKGROUND OF THE INVENTION

1. Field of the Invention

The present invention relates to shelving systems and more particularly to a shelf support assembly for a modular, adjustable shelving system which uses a plurality of horizontal support members.

2. Description of the Related Art

Presently available adjustable shelving systems generally require relatively complicated bracketing assemblies. Many of these bracketing systems rely on slotted systems such as that disclosed by U.S. Pat. No. 693,127, issued to P. H. Gardner et. al., entitled "ADJUSTABLE BRACKET". The '127 patent discloses the combination of a supporting-bar provided with keyhole-slots, and a bracket consisting of a metal bar bent to form horizontal and vertical arms, a brace-bar secured to the outer end of the horizontal part and to the lower of the vertical arm. The brace-rod extends through and projects from the vertical arm so as to form a projecting stud and a headed stud attached to the upper part of the vertical arm.

Another slotted system is disclosed in U.S. Pat. No. 2,653,783, issued to D. E. Lindsay, entitled "DISPLAY DEVICE". The '783 patent discloses a shelf-supporting structure comprising a pair of spaced apart vertical channel members characterized by slots equally spaced along the length thereof, a plurality of shelf brackets having lugs adapted to engage the slots of the channel members, and, according to a modification of the invention, a plurality of angle clips adapted to be mounted on the unsupported ends of the shelf brackets.

U.S. Pat. No. 920,633, issued to J. Oppenheimer, entitled "METAL SHELF BRACKET" discloses the combination with spaced supporting plates having spaced perforated ears extending laterally therefrom, brackets extending at right angles to the plates and each formed from a single strand of wire bent upon itself to produce a horizontally disposed loop open at its rear end and having vertically spaced upper end lower parallel walls. The wire forming the parallel walls of each loops are bent laterally in opposite directions at the open end of the loop to produce diverging arms, the terminals of which are inclined outwardly to form angularly disposed fingers adapted to enter the perforations in the ears of the adjacent supporting plate from the inner faces of the ears and project through and beyond the outer faces of the ears. The loops are horizontally aligned and adapted to receive and support a shelf.

Other shelving systems are disclosed in U.S. Pat. Nos. 4,076,203; 733,037; 438,741; and Des. 239,251.

As will be disclosed below, the present invention provides a simple, inexpensive, modular shelving system which allows lateral shelving to be added by the addition of a single shelf support assembly. The prior art, on the other hand, generally requires the addition of two bracket assemblies when lateral extension of shelving is desired.

SUMMARY OF THE INVENTION

The shelf support assembly of the present invention comprises an elongated, vertical support member; a plurality of substantially U-shaped, horizontal support members; and a vertically disposed, elongated, connecting member. The vertical support member has a first side and a second side. The U-shaped, horizontal support members are in spaced parallel relationship along at least a portion of the length of the vertical support member. The horizontal support members each comprise a base portion with first and second arms depending therefrom. The ends of each of the first arms are securely connected to the first side of the vertical support member and the ends of each of the second arms are securely connected to the second side of the vertical support member. The vertically disposed connecting member is securely attached to the base portions of the U-shaped, horizontal support members to provide rigidity of the shelf support assembly.

When two support assemblies are positioned in spaced planar relationship to each other at a desired distance to accommodate a shelf, such a shelf may be supported at a first end by at least one arm of one of the U-shaped, horizontal support members and at a second end by at least one arm of an associated U-shaped, horizontal support member on the other support assembly.

In one embodiment, a wall mountable embodiment, the vertical support member comprises a first vertical support rod in spaced parallel relationship to a second vertical support rod, and means for securing the vertical support rods in that spaced parallel relationship. In a second embodiment, a floor model, the vertical support member comprises an elongated, weight bearing cylindrical body.

In both embodiments, additional lateral shelving may be provided by the addition of a single shelf support assembly rather than the addition of two shelf support assemblies, which is typically required in present shelving systems. The U-shaped, horizontal support members allow lateral (side-by-side) shelves to be supported at equal heights by that same horizontal support member. Additionally, shelves may be easily adjustable from one height to a different height. Furthermore, the present invention allows the shelves to be formed of a different material than that used to form the shelf support assembly.

Other objects, advantages and novel features of the present invention will become apparent from the following detailed description of the invention when considered in conjunction with the accompanying drawings.

BRIEF DESCRIPTION OF THE DRAWINGS

FIG. 1*b* is a right side elevation view of the embodiment of FIG. 1*a*.

FIG. 1*c* is a top plan view of the embodiment of FIG. 1*a*.

FIG. 1*d* is a rear elevation view of the embodiment of FIG. 1*a*.

FIG. 2*b* is a right side elevation view of the embodiment of FIG. 2*a*.

FIG. 2*c* is a top plan view of the embodiment of FIG. 2*a*.

FIG. 2*d* is a rear elevation view of the embodiment of FIG. 2*a*.

The same elements are parts throughout the figures are designated by the same reference characters.

DETAILED DESCRIPTION OF THE PREFERRED EMBODIMENTS

Figure 1A:
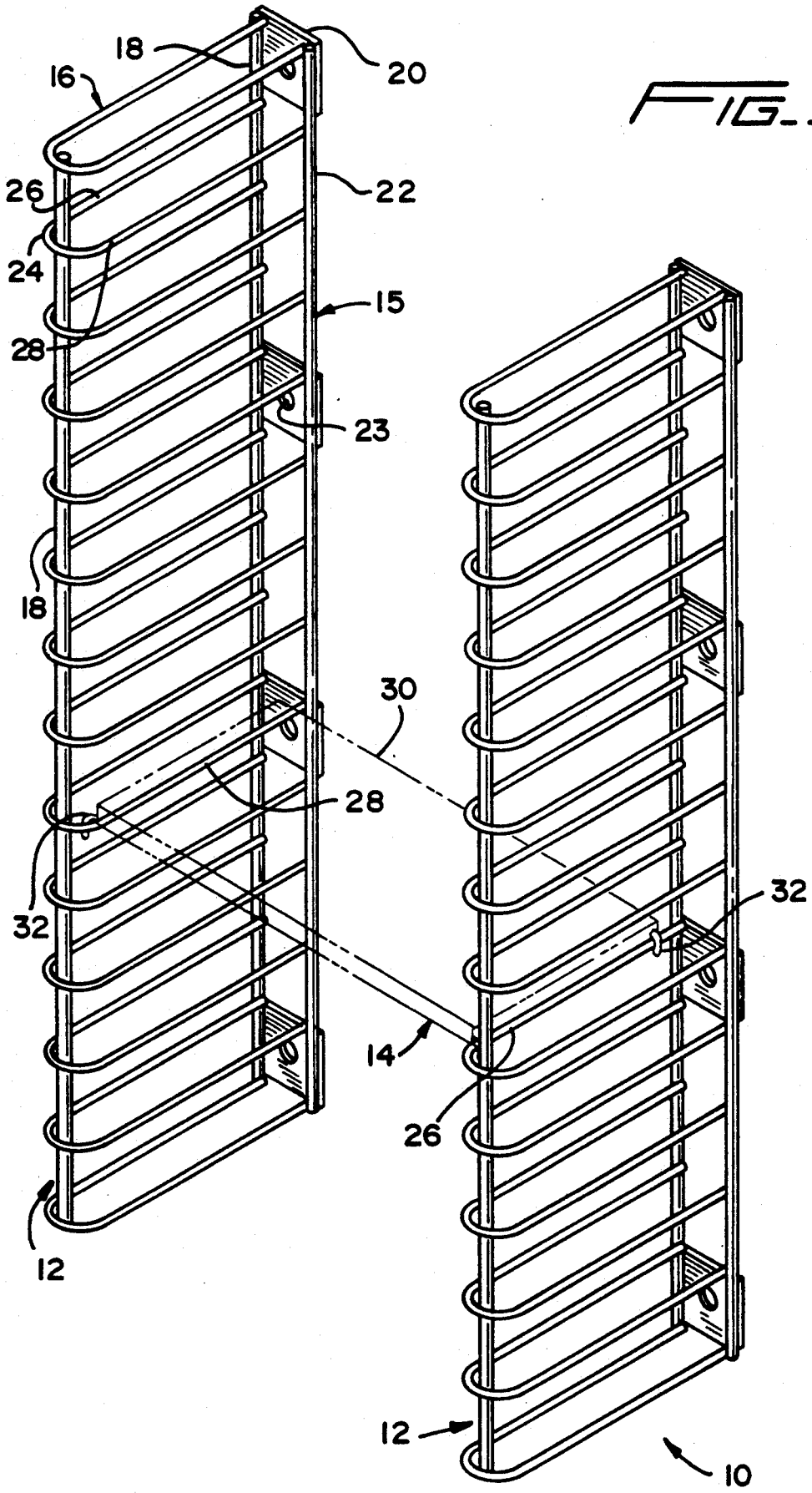
FIG. 1*a* is a front perspective view of a wall mountable model of the present invention.
Figure 2A:
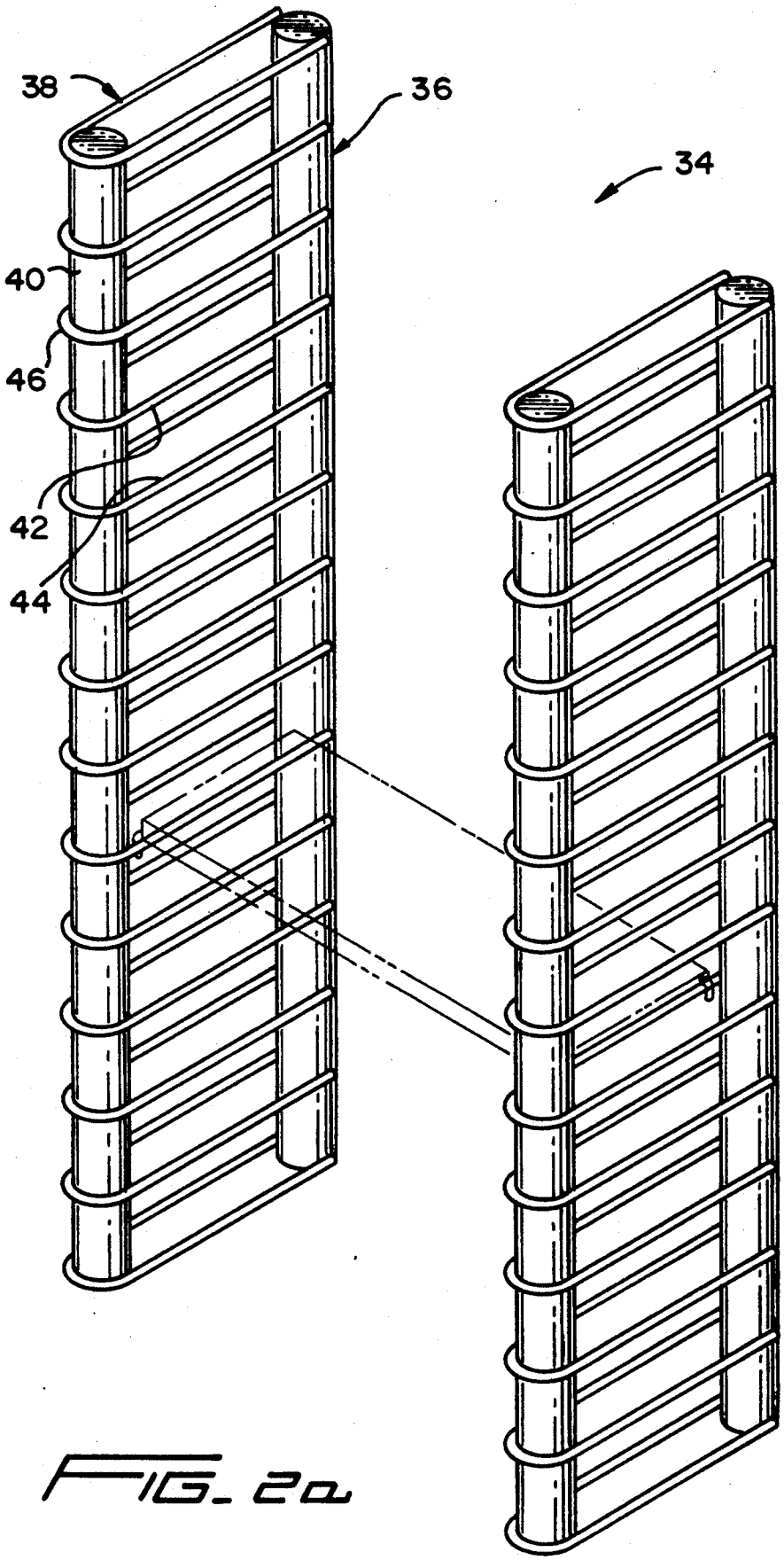
FIG. 2*a* is a front perspective view of a floor supported embodiment of the present invention.

Referring to the drawings and the characters of reference marked thereon, FIGS. 1*a–d* illustrate the adjustable shelving system of the present invention, designated generally as 10. The figure illustrates the use of two shelf support assemblies, each designated 12 which are adapted to receive and support a shelf 14. Each shelf support assembly or support bracket 12, comprises an elongated, vertical support member 15, a plurality of substantially U-shaped, horizontal support members 16, and a vertically disposed, elongated, connecting member 18.

The vertical support member 15, comprises a first rod 18 on one side thereof connected by a mounting plate 20 to a second rod 22 on the other side of the vertical support member 15. The mounting plate 20 supports the rods 18, 22 in spaced parallel relationship with respect to each other. Mounting plate 20 has an opening 23 formed therein for mounting the support bracket 12 to a wall.

The U-shaped, horizontal support members 16, each comprise a base portion 24 with first and second arms 26, 28 depending therefrom. The ends of each of the first arms 26 is securely connected (preferably by welding) to the first rod 18 of the vertical support member 15 and the ends of each of the second arms 28 are securely connected to the second rod 22 of support member 15. Connecting member or rod 18 is securely attached to the base portions 24 of the horizontal support members 16 to provide rigidity of the shelf support assembly 12.

As can be readily by reference to FIG. 1*a*, when two support assemblies 12 are positioned in spaced planar relationship to each other at a desired distance to accommodate a shelf 14, the shelf 14 may be supported at a first end by one arm of a horizontal support member and at a second end by one arm 26 of an associated U-shaped, horizontal support member on the other support assembly 12. In addition to the shelve's main portion 30, shelf 14 preferably includes angled end portions or fingers 32 which are positioned between the arms 26, 28 of a support member 16. The angled end portion 32 may engage only one arm of its associated support member 16, thereby leaving the other arm of that member 16 free to engage another shelf (not shown) which may be provided by supplying a third shelf support assembly 12. Thus, it is readily seen that each time one desires to add a set of shelves to the system 10 only one added support assembly 12 is required. Furthermore, the utilization of the U-shaped, horizontal support members 16 allows shelves to be maintained side-by-side at equal heights.

Referring now to FIGS. 2*a–d*, a floor supported embodiment of the invention is illustrated, designated generally as 34. As in the previous embodiment, floor supported embodiment 34 comprises an elongated support member, a plurality of substantially U-shaped, horizontal support members 38, and a vertically disposed, elongated, connecting member 40. However, in this embodiment, the vertical support member 36 comprises an elongated weight bearing cylindrical body. Similarly, the connecting member 40 comprises another similarly dimensioned weight bearing cylindrical body. Each first arm 42 of each horizontal support member 38 is securely attached to one side of the cylindrical body 36 while the other arm 44 is attached to the opposite side of the cylindrical body 36. Thus, the cylindrical body 36 forms a rear support for the resulting shelving system 34. Likewise, cylindrical body 40 forms a front support for the system 34. The base portion 46 of each of the U-shaped, horizontal support members 38 has substantially the same curvature as the outer diameter of the front, weight bearing body 40, each base portion 46 curving around the front cylindrical body 40.

The rods of the FIG. 1 embodiment are preferably wrought iron wiring having diameters in a range of about 0.13" to 0.25". (The horizontal support member of the FIG. 2 embodiment has similar dimensions.) The cylindrical bodies of the FIG. 2 embodiment may be piping, tubing or may be solid having diameters in a range of about 0.5" to 1.5".

Obviously, many modifications and variations of the present invention are possible in light of the above teachings. It is therefore to be understood that, within the scope of the appended claims, the invention may be practiced otherwise than as specifically described.

What is claimed and desired to be secured be Letters Patent of the United States is:

1. A shelf support assembly for an adjustable shelving support system, comprising:

a) at least two elongated, vertical support members, each having a first side and a second side;

b) a plurality of substantially U-shaped, horizontal, support members in spaced parallel relationship along at least a portion of the length of each said vertical support member, said horizontal support members each comprising a base portion with first and second arms depending therefrom, the ends of each of said first arms being securely connected to said first side of said vertical support member and the ends of each of said second arms being securely connected to said second side of said vertical support member; and c) at least two vertically disposed, elongated, connecting members, each securely attached to the base portions of said U-shaped, horizontal support members of a respective support member to provide rigidity of said shelf support assembly, wherein, when said at least two support assemblies are positioned in spaced, planar relationship to each other at a desired distance to accommodate a shelf, such a shelf may be supported at a first end by at least one arm of one of said U-shaped, horizontal support members and at a second end by at least one arm of an associated U-shaped, horizontal support member on the other support assembly.

2. The shelf support assembly of claim 1 wherein each said vertical support member comprises a first vertical support rod in spaced parallel relationship to a second vertical support rod, and means for securing said vertical support rods in said spaced parallel relationship.

3. The shelf support assembly of claim 2 wherein said means for securing said vertical support rods comprises a plurality of vertically spaced mounting plates, each being securely attached to the ends of said arms and to said vertical support rods.

4. The shelf support assembly of claim 3 wherein each mounting plate includes an opening formed therein for mounting said support bracket to a wall.

5. The shelf support assembly of claim 2 wherein each said vertically disposed, elongated connecting member comprises a connecting rod having approximately the same diameter as said first and second vertical support rods.

6. The shelf support assembly of claim 2 wherein the first and second arms of said horizontal support members are securely attached between said vertical support rods, each arm being disposed adjacent to an associated vertical support rod.

7. An adjustable shelving system, comprising:

a plurality of shelf support assemblies, each comprising:

a) an elongated, vertical support member having a first side and a second side;

b) a plurality of substantially U-shaped, horizontal, support members in spaced parallel relationship along at least a portion of the length of said vertical support member, said horizontal support members each comprising a base portion with first and second arms depending therefrom, the ends of each of said first arms being securely connected to said first side of said vertical support member and the ends of each of said second arms being securely connected to said second side of said vertical support member; and c) a vertically disposed, elongated, connecting member securely attached to said base portions of said U-shaped, horizontal support members to provide rigidity of said shelf support assembly, at least two of said shelf support assemblies being positioned in spaced planar relationship to each other at a desired distance to accommodate a shelf; and, a shelf supportable at a first end by at least one arm of one of said U-shaped, horizontal support members and at a second end by at least one arm of an associated U-shaped, horizontal support member on the other support assembly.

8. The adjustable shelving system of claim 7 wherein said shelf comprises wherein a main portion and angled end portions, each of said angled end portions being locatable between the arms of an associated, U-shaped, horizontal support member, one arm of said associated U-shaped, horizontal support member supporting that end of the shelf, the other arm of said associated U-shaped, horizontal member being free to engage another shelf.

9. A shelf support assembly for an adjustable shelving system, comprising:

a) an elongated, vertical support member, comprising an elongated rear, weight bearing cylindrical body, having a first side and a second side;

b) a plurality of substantially U-shaped, horizontal, support members in spaced parallel relationship along at least a portion of the length of said vertical support member, said horizontal support members each comprising a base portion with first and second arms depending therefrom, the first arm of each horizontal support member being securely attached to one side of said rear, weight bearing cylindrical body and the second arm of each horizontal support member being securely attached to an opposite side of said cylindrical body; and c) a vertically disposed, elongated, connecting member securely attached to the base portions of said U-shaped, horizontal support members to provide rigidity of said shelf support assembly, wherein, when two support assemblies are positioned in spaced, planar relationship to each other at a desired distance to accommodate a shelf, such a shelf may be supported at a first end by at least one arm of one of said U-shaped, horizontal support members and at a second end by at least one arm of an associated U-shaped, horizontal support member on the other support assembly, said cylindrical body forming the rear support for the resulting shelving system.

10. The shelf support assembly of claim 9 wherein said vertically disposed, elongated, connecting member comprises a front, weight bearing cylindrical body having dimensions substantially equal to the dimensions of said rear cylindrical body.

11. The shelf support assembly of claim 9, wherein the base portion of each of said U-shaped, horizontal support members has substantially the same curvature as the outer diameter of said front, weight bearing cylindrical body, each base portion curving around said front cylindrical body.

* * * * *